United States Patent [19]

Toivonen et al.

[11] 4,402,233

[45] Sep. 6, 1983

[54] APPARATUS FOR DRIVING A ROTATABLE MANTLE MOUNTED ON A FIXED AXLE

[75] Inventors: Pentti Toivonen; Juhani Ovaska, both of Jyväskylä, Finland

[73] Assignee: Valmet OY, Finland

[21] Appl. No.: 232,308

[22] Filed: Feb. 6, 1981

[30] Foreign Application Priority Data

Feb. 7, 1980 [FI] Finland ..... 800386

[51] Int. Cl.[3] ..... F16H 57/00; B60B 15/16; B21B 13/02

[52] U.S. Cl. ..... 74/411; 29/115; 29/116 R

[58] Field of Search ..... 74/411, 410, 414; 464/149, 158; 29/148.4 D, 115, 116, 116 AD; 226/190, 194

[56] References Cited

U.S. PATENT DOCUMENTS

| | | | |
|---|---|---|---|
| 3,290,897 | 12/1966 | Kuehn | 29/115 |
| 3,639,956 | 2/1972 | Justus | 29/116 |
| 3,766,620 | 10/1973 | Roerig | 29/115 |
| 3,855,681 | 12/1974 | Andriola et al. | 29/115 |
| 3,889,334 | 6/1975 | Justus et al. | 29/115 |
| 3,997,952 | 12/1976 | Lehmann | 29/115 |
| 4,271,574 | 6/1981 | Matikainen | 29/115 |

FOREIGN PATENT DOCUMENTS 56434 9/1979 Finland .

*Primary Examiner*—Leslie A. Braun
*Assistant Examiner*—Michael D. Bednarek
*Attorney, Agent, or Firm*—Steinberg & Raskin

[57] ABSTRACT

Apparatus for driving a rotatable mantle, such as a mantle of a deflection compensated roll of a paper machine, which is mounted by bearings on a fixed axle, includes a substantially tubular axle fixed to an end of the rotatable mantle. A housing or gear box which constitutes a carrier for at least one drive gear, is mounted by bearings on the tubular axle so that the housing or gear box and the gears associated therewith are fixed to the mantle so as to follow any deflections thereof. Rotation preventing apparatus are provided for fixing the housing or gear box against rotation around the fixed axle yet which permits the housing or gear box to follow any deflections of the mantle. The rotation preventing apparatus includes a toothed coupling member which extends between and is coupled to the housing or gear box and a bearing block in which an end of the fixed axle is mounted.

8 Claims, 3 Drawing Figures

APPARATUS FOR DRIVING A ROTATABLE MANTLE MOUNTED ON A FIXED AXLE

BACKGROUND OF THE INVENTION

This invention relates generally to apparatus for driving rotatable rolls and, more particularly, to apparatus for driving a rotatable mantle which is mounted by bearings on a fixed axle, such as a mantle of a deflection compensated roll of a paper machine.

Apparatus for driving a rotatable mantle fitted by bearings on a fixed axle, such as the mantle of a deflection-compensated roll of a paper machine, are known and generally include one or more drive gears mounted on respective axles which themselves are fitted by bearings into a carrier located in the region of the end of the fixed axle. Such drive gear or gears mesh with and drive a gear ring connected to the rotatable mantle.

Reference is made to Finnish Publication Print No. 56,434 which illustrates a drive mechanism of the type with which the present invention is concerned. Such drive mechanism utilizes a drive gear or gears which mesh with and drive an internally toothed gear ring mounted on the rotatable mantle. The drive apparatus disclosed in Finnish Publication Print No. 56,434 has as its principal novel feature that the gear carrier is installed within a shell fixedly connected with the rotatable mantle and supported by rollers or slide-contact devices and/or within the rotatable mantle so that the carrier is able to assume a position with the mantle as a fixed unit. The carrier is clutched so as to be fixed against rotation around the fixed axle by suitable devices which allow the carrier to assume positions along with the mantle as described above.

The apparatus disclosed in Finnish Publication Print No. 56,434 has been found to have certain drawbacks. One such drawback is that the apparatus necessitates the use of special bearings having quite large diameters and whose rolling surfaces are expensive and difficult to manufacture due to the extensive machining, tempering and grinding operations. Standard bearings having integral outer and inner races cannot be utilized in the disclosed apparatus. A second drawback of the known apparatus is that it is necessary in the construction of the apparatus to machine the fixed center axle of the roll or mantle in order to provide spaces for the drive gear or gears. This creates problems particularly when low drive ratios are required as the diameter of the gears therefore become large thereby making it necessary to machine the center axle to a larger extent with consequent loss of strength of the axle.

Another problem which is not solved by the apparatus disclosed in Finnish Publication Print No. 56,434 is in the sealing of the gear box constituting the gear carrier. Thus, in the apparatus disclosed therein, it is necessary to seal a ring-shaped axle opening at the outer end of the gear box with respect to the outside surface. Still another drawback of the known drive apparatus is that the outer diameter of the gear drive is the same in all directions and that due to the particular construction it is difficult to reduce the size of this diameter to less than the diameter of the roll which is desirable from the point of view to facilitate mating of the drive gears with the particular roll.

Reference is also made to U.S. Pat. No. 3,889,334 which illustrates a drive mechanism for a rotatable mantle fitted with bearings on a fixed axle of the type having a feature wherein the gear box is fixedly attached to a stand on which an end of the fixed axle of the rotatable mantle is supported. However, this drive apparatus is not entirely satisfactory in that the same requires the use of floating gears which tend to cause noise and vibrations. Another problem in the apparatus disclosed in this U.S. patent is in making the seal between the end portion of the deflecting roll and the gear box a tight and secure one.

SUMMARY OF THE INVENTION

Accordingly, one object of the present invention is to provide new and improved drive apparatus of the type described above which eliminate the drawbacks mentioned above.

Another object of the present invention is to provide new and improved drive apparatus which utilizes only standard bearings thereby resulting in a more economical construction as well as more reliable operation at least from the point of view of the bearings.

Still another object of the present invention is to provide such new and improved drive apparatus wherein substantially no machining of the center axle of the roll or mantle is required and where the complete gear box can be constructed and situated outside of the center axle.

A further object of the present invention is to provide new and improved drive apparatus wherein sealing problems are eliminated.

A still further object of the present invention is to provide new and improved drive apparatus wherein the latter extends in a lateral direction relative to the roll to be driven in order to avoid spacial problems in the vertical direction.

Yet another object of the present invention is to provide new and improved drive apparatus which eliminate the use of floating gears.

Briefly, in accordance with the present invention, these and other objects are attained by providing that in drive apparatus of the type described above, the housing or gear box of the gear drive along with the components contained therein are mounted by bearings on a substantially tubular axle which is fixed to the end of the rotatable mantle so that the housing or gear box and associated components are fixed to the mantle to follow any deflections thereof. Additionally, rotation preventing apparatus are provided by which the housing or gear box is fixed against rotation about the fixed axle and yet which permits the housing or gear box to follow any deflections of the mantle. The rotation preventing apparatus in the illustrated embodiment comprises a toothed coupling member which extends between and is coupled to the housing or gear box and to a bearing block in which an end of the fixed axle is mounted.

Drive apparatus constructed in accordance with the present invention provides significant advantages relative to conventional apparatus, such as that illustrated in U.S. Pat. No. 3,889,334. For example, the housing or gear box in accordance with the invention moves along with the roll or mantle and thereby ensures good gear meshing in all operating conditions without the use of floating gears. The present invention allows improved sealing between the gear box and the roll mantle in that such sealing will always function centrically, i.e., will always remain stationary relative to the components to which the same is fixed. Another important advantage of the present invention is that during construction of the roll, the peripheral position of the axle is easy to adjust merely by turning the stand until the meshing teeth of the toothed coupling member are in appropriate position.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
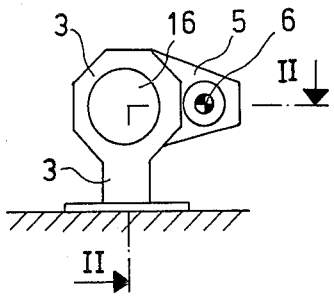
FIG. 1 is a schematic elevation view of drive apparatus in accordance with the present invention.
Figure 2:
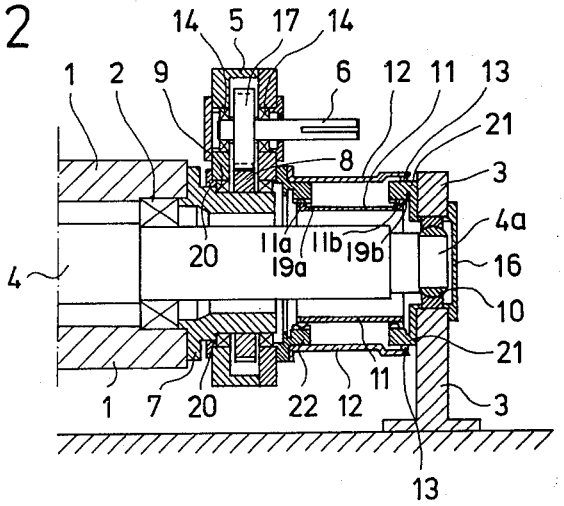
FIG. 2 is a section view taken along the line II—II in FIG. 1.

Referring to FIGS. 1 and 2, a cylindrical mantle 1 such, for example, as the mantle of a deflection-compensated roll of a paper machine, is rotatably mounted by bearings 2 on a massive fixed axle 4. The axle 4 terminates at a reduced diameter end region 4*a* on which a spherical joint bearing 10 is mounted. The spherical bearing 10 is supported in an opening formed in bearing block 3, a cover plate 16 extending over the bearing assembly. Such construction is conventional for rotatable mantles such as a mantle of a deflection compensated roll of a paper machine.

A substantially tubular axle 7 is fixed to the end of mantle 1 of the roll so as to form an extension thereof. A secondary or driven gear 8 having external toothing is concentrically mounted over the tubular axle 7. The secondary gear 8 is driven by a primary or driving gear 17 which is fixed to primary axle 6. The axle 6 is mounted by bearing 14 in the housing or gear box 5 of the drive apparatus. The primary axle 6 is driven by conventional equipment through, for example, a cardan shaft or the like.

The housing or gear box 5 of the drive apparatus is supported by the bearing block 3 which also supports the end of fixed axle 4 through bearing assembly 10 by means of a substantially cylindrical axle or sleeve 11. Externally toothed rings 11*a* and 11*b* are provided on the respective ends of the tubular sleeve 11. The externally toothed ring 11*a* of sleeve 11 meshes with an internally toothed ring provided on a first annular ring member 22 fixed to the housing or gear box 5 while the externally toothed ring 11*b* of sleeve 11 is in meshing engagement with an internally toothed ring provided on a second annular ring member 21 which is fixed to the bearing block 3. Thus, the internal toothed rings formed on the first and second annular ring members 22 and 21 are in opposed, substantially concentric relationship and mesh with respective externally toothed rings 11*a* and 11*b* formed on the ends of the tubular sleeve 11. As seen in FIG. 2, the construction of the internal and external toothed rings are such that the housing or gear box 5 together with the annular ring member 22 can move to follow any deflections of the mantle to which the same are fixed through tubular axle 7 since the meshing gears can slide or pivot with respect to each other. However, the particular construction of the toothing on the annular ring members 21 and 22 and sleeve 11 fixes the housing or gear box 5 against rotation about the fixed axle 4, i.e., the housing or gear box 5 cannot rotate about the axis of fixed axle 4. In this manner, the toothed portions of sleeve 11 and annular ring members 21 and 22 mesh at regions 19*a* and 19*b* to thereby fix the housing or gear box 5 against rotation about the fixed axle 4 and which permits the housing or gear box to follow any deflections of the mantle 1.

An end seal 20 seals the space on one side of housing or gear box 5 between it and the tubular axle 7 which comprises an extension of the roll mantle 1. Since the present invention provides that the housing or gear box 5 will follow any deflections of the mantle 1 and its extension 7, the seal provided by seal 20 will function in a reliable manner since the same will be centric under all operating conditions.

Figure 3:
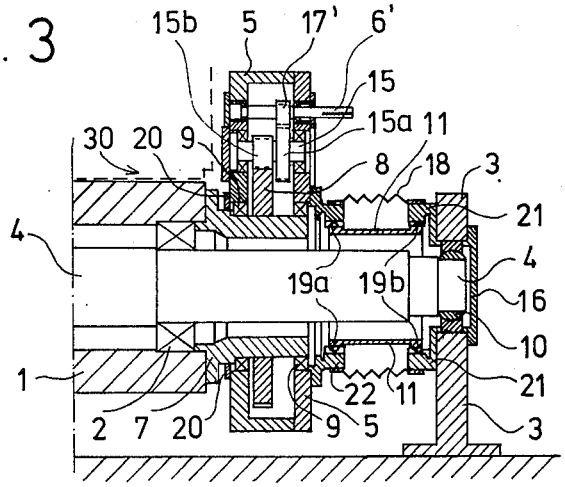
FIG. 3 is a view similar to FIG. 2 and illustrating another embodiment of the present invention.

Referring to FIG. 3, a second embodiment of the present invention is illustrated which is essentially the same as the embodiment illustrated in FIG. 2 but which differs therefrom in the following manner. In lieu of drive gear 17 of the embodiment shown in FIG. 2, a drive or primary gear 17' is fixed to a primary shaft 6'. The primary gear 17' drives a first intermediate gear 15*a* fixed to intermediate axle 15 and on which a second intermediate gear 15*b* is also fixed. The second intermediate gear 15*b* drives the secondary or driven gear 8 fixed over the tubular axle 7. Thus, it is seen that the present invention is suitable for use in connection with several drive gears to achieve any desired gear ratios.

Referring back to FIG. 2, a tubular shield member 12 extends over the cylindrical sleeve 11. One end of the tubular shield 12 is fixed to the first annular ring member 22 while the other end of the tubular shield is sealed to the second annular ring member 21 by a flexible sealing element 13. Such sealing arrangement allows the housing or gear box 5 to follow the deflections of mantle 1. In the embodiment illustrated in FIG. 3, a bellows type elastic shield member 18 extends over the cylindrical sleeve and has respective ends which are fixed to respective ones of the first and second annular ring members 21 and 22. Thus, shield member 18 effectively seals the space therewithin in the same manner as the tubular shield member 12 and allows the housing or gear box 5 to follow the displacement of mantle 1 in like manner.

A mating roll 30 is illustrated in phantom in FIG. 3 and illustrates the manner in which a nip can be formed with the roll mantle 1 which is equipped with a drive mechanism according to the present invention.

From the above, it is seen that drive apparatus are provided which will insure good meshing engagement and which does not require floating gears. Only standard bearings are required in the apparatus and sealing problems are eliminated in that the end sealing between the housing or gear box and the roll mantle will always function in a centric manner. The central fixed axle 4 requires no machining and the entire gear box can be constructed outside of the axle. As best seen in FIG. 1, the drive apparatus extends substantially laterally from the roll so that space problems are avoided in the vertical direction.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In apparatus for driving a rotatable mantle, such as a mantle of a deflection-compensated roll of a paper machine, mounted by bearings on a fixed axle and including at least one drive gear mounted on a respective shaft which itself is fitted with bearings in a carrier situated in the region of an end of the fixed axle and wherein said at least one drive gear is adapted to drive a secondary gear ring coupled to the rotatable mantle, the improvement comprising:

a substantially tubular axle fixed to an end of said rotatable mantle;

a housing or gear box constituting said carrier for said at least one drive gear mounted by bearings on said tubular axle which is fixed to said rotatable mantle so that said housing or gear box and associated components are fixed to said mantle to follow any deflections thereof; and rotation preventing means for fixing said housing or gear box against rotation about said fixed axle and for permitting the housing or gear box to follow any deflections of said mantle, said rotation preventing means including a toothed coupling member.

2. The combination of claim 1 wherein said toothed coupling member extends between and is coupled to said housing or gear box and a bearing block in which an end of said fixed axle is mounted.

3. The combination of claim 2 further including a first annular ring member fixed to said housing or gear box and a second annular ring member fixed to said bearing block, said first and second annular ring members being in opposed, substantially concentric relationship, and each having an internal gear tooth ring, and wherein said toothed coupling member constitutes a substantially cylindrical sleeve having an external gear tooth ring at each of its ends in meshing engagement with the internal gear tooth ring of a respective one of said annular ring members.

4. The combination of claim 3 further including a tubular shield member extending over said cylindrical sleeve, one end of said tubular shield being fixed to said first annular ring member and the other end of said tubular shield being sealed to said second annular ring member by a flexible sealing element.

5. The combination of claim 3 further including a bellows-type elastic shield member extending over said cylindrical sleeve, respective ends of said elastic shield being fixed to respective ones of said first and second annular ring members.

6. The combination of claim 3 wherein said secondary gear ring coupled to the rotatable mantle and which is driven by said at least one drive gear comprises a gear ring fixed to said tubular axle which is fixed to an end of said rotatable mantle.

7. The combination of claim 6 wherein said at least one drive gear comprises a primary gear mounted on a primary shaft fitted with bearings in said housing or gear box, said primary gear and secondary gear ring being in meshing engagement.

8. The combination of claim 6 wherein said at least one drive gear comprises a primary gear mounted on a primary shaft fitted with bearings in said housing or gear box, first and second intermediate gears mounted on an intermediate shaft fitted with bearings in said housing or gear box, said first intermediate and primary gears being in meshing engagement and said second intermediate gear and secondary gear ring being in meshing engagement.

* * * * *